US009115471B2

(12) United States Patent
Zitturi et al.

(10) Patent No.: US 9,115,471 B2
(45) Date of Patent: Aug. 25, 2015

(54) OIL-RESISTANT FILTER WRAPPER PAPER

(71) Applicant: DELFORTGROUP AG, Traun (AT)

(72) Inventors: Roland Zitturi, Innsbruck (AT); Dietmar Volgger, Schwaz (AT); Dieter Möhring, Wattens (AT)

(73) Assignee: delfortgroup AG, Traun (AT)

( * ) Notice: Subject to any disclaimer, the term of this patent is extended or adjusted under 35 U.S.C. 154(b) by 0 days.

(21) Appl. No.: 14/536,973

(22) Filed: Nov. 10, 2014

(65) Prior Publication Data

US 2015/0059996 A1 Mar. 5, 2015

Related U.S. Application Data

(60) Division of application No. 14/165,629, filed on Jan. 28, 2014, now Pat. No. 8,939,155, which is a continuation of application No. PCT/EP2012/002985, filed on Jul. 16, 2012.

(30) Foreign Application Priority Data

Jul. 28, 2011 (EP) ..... 11175809

(51) Int. Cl.

| | |
|---|---|
| ***D21H 27/08*** | (2006.01) |
| ***D21H 17/67*** | (2006.01) |
| ***D21H 17/68*** | (2006.01) |
| ***D21H 15/06*** | (2006.01) |
| ***A24D 3/06*** | (2006.01) |
| ***A24D 1/02*** | (2006.01) |
| ***D21H 17/31*** | (2006.01) |
| ***A24D 3/02*** | (2006.01) |
| *D21H 17/27* | (2006.01) |
| *D21H 17/28* | (2006.01) |
| *D21H 17/30* | (2006.01) |
| *D21H 17/32* | (2006.01) |

(52) U.S. Cl.

CPC ..... *D21H 27/08* (2013.01); *A24D 1/02* (2013.01); *A24D 3/02* (2013.01); *A24D 3/06* (2013.01); *A24D 3/061* (2013.01); *D21H 15/06* (2013.01); *D21H 17/28* (2013.01); *D21H 17/30* (2013.01); *D21H 17/31* (2013.01)

(58) Field of Classification Search

USPC ..... 162/135, 137, 141, 158, 175–178, 162/181.1, 181.4, 181.8, 139, 183–184; 131/331, 95, 105

See application file for complete search history.

(56) References Cited

U.S. PATENT DOCUMENTS

| | | | | |
|---|---|---|---|---|
| 4,548,677 | A | 10/1985 | Scheider et al. | 162/139 |
| 4,984,589 | A | 1/1991 | Riedesser | 131/365 |
| 5,722,433 | A | 3/1998 | Ishino | 131/365 |
| 5,849,153 | A | 12/1998 | Ishino | 162/135 |
| 5,979,460 | A | 11/1999 | Matsumura | 131/343 |
| 8,017,249 | B2 | 9/2011 | Tippit | 428/532 |
| 8,110,071 | B2 | 2/2012 | Ullmann et al. | 162/158 |
| 2003/0178039 | A1 | 9/2003 | White et al. | 131/365 |
| 2008/0142028 | A1 | 6/2008 | Fagg | 131/361 |
| 2009/0120450 | A1 | 5/2009 | Herve et al. | 131/365 |
| 2010/0108085 | A1 | 5/2010 | Duke | 131/339 |
| 2012/0080156 | A1 * | 4/2012 | Laleg et al. | 162/158 |
| 2012/0325232 | A1 | 12/2012 | Yokogawa et al. | 131/337 |

FOREIGN PATENT DOCUMENTS

| | | | | |
|---|---|---|---|---|
| CA | 2467601 | | 11/2004 | D21H 19/34 |
| CA | 2467601 | A1 * | 11/2004 | |
| DE | 145863 | * | 1/1981 | |
| DE | 102012208583 | * | 8/2013 | |
| KR | 1020110076355 | * | 6/2011 | |

OTHER PUBLICATIONS

Machine Translation of DE 102012208583 B3, European Patent Office, [online], retrieved from the Internet, [retrieved Oct. 3, 2014], <URL:http://worldwide.espacenet.com/?locale=EN_ep>.*

Machine Translation of KR 1020110076355, The Korean Intellectual Property Office, [online], retrieved from the Internet, [retrieved Oct. 3, 2014], <URL: http://kposd.kipo.go.kr:8088/up/kpion/>.*

Machine Translation of DE 102012208583 B3, European Patent Office, [online], retrieved from the Internet, [retrieved Oct. 3, 2014], URL:http://worldwide.espacenet.com/?locale=EN_ep.

Machine Translation of KR 1020110076355, The Korean Intellectual Property Office, [online], retrieved from the Internet, [retrieved Oct. 3, 2014], <URL:http://kposd.kipo.go.kr:8088/up/kpion>.

International Search Report in International Application No. PCT/EP2012/002985 dated Sep. 13, 2012, 3 pages.

* cited by examiner

*Primary Examiner* — Dennis Cordray

(74) *Attorney, Agent, or Firm* — Sunstein Kann Murphy & Timbers LLP

(57) ABSTRACT

A method of producing a filter wrapper paper for a smoking article is described. The paper has a content of long-fiber pulp of at least 30 wt %, preferably at least 40 wt %, relative to the pure fiber mass of the paper. The freeness of the long-fiber pulp as per ISO 5267, Schopper-Riegler method, is between 80° SR and 100° SR, preferably between 85° SR and 95° SR. The filter wrapper paper has a filler content of less than 10 wt %, preferably less than 8 wt %, and especially preferably less than 6 wt % relative to the total mass of the paper and is impregnated with a material that is suitable for forming an aqueous composition, more particularly an aqueous solution or an aqueous suspension. The oil-resistance of the filter wrapper paper has a KIT level of at least 4, preferably at least 5, according to TAPPI T559 cm-02.

9 Claims, No Drawings

OIL-RESISTANT FILTER WRAPPER PAPER

This application is a divisional of U.S. patent application Ser. No. 14/165,629, filed Jan. 28, 2014, which is a continuation of Patent Cooperation Treaty Application PCT/EP2012/002985, filed on Jul. 16, 2012, which claims priority from European Patent Application 11 175 809.0, filed on Jul. 28, 2011; all of which are incorporated herein by reference in their entirety.

TECHNICAL FIELD

The present invention lies in the field of paper production for smoking articles. Particularly, it concerns a filter wrapper paper for a smoking article, a method for producing same, and also a smoking article that makes use of such a filter wrapper paper.

BACKGROUND ART

A commercially available filter cigarette consists of a cylindrical, round or oval, tobacco rod, which is wrapped by a cigarette paper, a likewise shaped filter plug, which is surrounded by a filter wrapper paper, and also a tipping paper, which is usually adhered to the entire filter wrapper paper and to a part of the cigarette paper wrapping the tobacco rod and hence connects the filter plug to the tobacco rod.

The filter plug itself can consist of different materials, often cellulose acetate fibers are used, partly in combination with particles of activated carbon. The filter wrapping paper wrapping the filter plug is usually adhered to the surface of the filter plug along one or more narrow band-shaped areas, which usually extends or extend respectively along a direction parallel to the axis of symmetry of the filter plug. The filter wrapper paper is normally also adhered to itself along a narrow seam to prevent the filter plug from bursting open. For that purpose, a large number of different adhesives are used in the prior art, although polyvinyl acetate or hot-melt adhesives are often utilized.

Typical filter wrapper papers in the range of comparatively low and medium air permeability are composed of wood pulp, wherein a mixture of long or short fibers, depending on the desired paper properties, is used. Furthermore, these papers typically contain mineral fillers, for example calcium carbonate, kaolin, talcum, titanium dioxide or other mineral fillers and mixtures thereof Additionally or alternatively, other additives can be provided to achieve special properties, for example wet-strength additives.

Such filter wrapper papers are produced on paper machines, for example on Fourdrinier wire machines.

The cellulose fibers used for paper production are typically differentiated into long and short fibers, wherein the long fibers are typically cellulose fibers obtained from coniferous wood, such as spruce or pine, with a length of more than 2 mm, whereas short fibers are obtained from deciduous wood such as birch, beech or eucalyptus, typically having a length of less than 2 mm, often about 1 mm.

In a first step of paper production, the pulp is suspended in water and then refined in a beating machine or what is known as a refiner. It is common for short and long fibers to be refined separately. The intensity with which the pulp has been refined is determined by measurement of the refining degree, for example according to ISO 5267 ("Pulps. Determination of drainability—Part 1: Schopper-Riegler method"). The result of this measurement is given in Schopper-Riegler degrees (° SR). Typically, the long-fiber pulp for use in filter wrapper papers is refined to a degree of 50-70° SR.

Short-fiber pulp is mostly refined considerably less severely and reaches a refining degree of 15° SR to 40° SR. The refining of short-fiber pulp can also be omitted completely.

After adding fillers, for example calcium carbonate, kaolin, talcum, titanium dioxide or other mineral fillers or mixtures thereof, the fiber filler suspension flows from the headbox of the paper machine to the wire and can be dewatered there by various means, for example by gravity or vacuum. After, the moist fiber web can be passed through the press section, where it is dried by mechanical pressure against a drying felt. Finally, the fiber web can pass through the drying section, where it is dried by contact with cylinders, which for example are steam-heated. Subsequently the finished paper can be rolled up. It is possible to perform further processing steps on the paper machine, for example sizing in a size or film press, the application of watermarks, embossing, impregnation, etc.

The finished filter wrapper paper is then normally present in form of a reel, with a width corresponding to the width of the paper machine. This reel is then generally cut into narrower reels, or what are known as bobbins, the width of which results from the circumference of the filter plugs and the desired width of the adhesive seam. A typical bobbin is about 5000 to 6000 m long and has a width of 25 to 27 mm. Significant deviations in length and width of the bobbin are possible to adapt to the wide spectrum of commercially available cigarette filters. Moreover it is common for the width of a bobbin to be about an integer multiple of the width necessary for the production of one filter plug, since filter production machines can readily produce more, typically two, filter rods in parallel simultaneously.

In some filter cigarettes, one or more capsules are introduced in the filter plug and can be destroyed by mechanical pressure. These capsules contain a fluid, mostly an oil with aromatic substances, for example menthol. Hence the smoker has the possibility, through pressure on the filter plug, for example applied by the fingers, to destroy this capsule/these capsules and to thereby release the aromatic substances. The released aromatic substances then flavor the smoke flowing through the filter plug and out of the mouth end of the cigarette, so that the smoker can perceive the aromatic substances. Thus, the smoker can control the taste impression of the cigarette by destroying the capsules. Such a filter cigarette is, for example, described in U.S. 2008/142028, which is incorporated herein by reference in its entirety.

The liquid leaking out of the destroyed capsules has the tendency to penetrate through the filter wrapper paper and likewise through the tipping paper however, so that spots become visible on the outer surface of the cigarette. These spots are perceptible for the smoker and compromise the visual appearance of the cigarette.

Such spots can be avoided if the filter wrapper paper forms a certain barrier against oil. The ability of a paper to form a barrier against oil is described hereinafter as "oil resistance" and can be measured by a test common in the paper and paper-processing industry according to Tappi T559 cm-02 "Grease Resistance Test for Paper and Paperboard". In this test, drops of 12 different test liquids sorted in ascending order according to their wetting ability are applied to the paper and it is then determined which of the liquids penetrates to the other side of the paper. The result of the test is the so-called KIT level, which describes for which test liquid the penetration to the other paper side occurred first. Hence it is described by a number between 1 and 12, wherein higher values correspond to a higher barrier effect against oil. In case the first test liquid penetrates through the paper, the result is denoted as "<1". For a filter wrapper paper for the application as described above, a KIT level of about 5 has proven to be sufficient to avoid the forming of spots on the cigarette.

One possibility to provide the paper with such a barrier function against oil or with "oil resistance" consists in coating the filter wrapper paper with fluorinated hydrocarbons, which provide the paper with oil-repellent properties. Such fluorinated hydrocarbons are commonly used for example in food packaging made out of paper, but are not allowed for use in cigarettes in many countries. Additionally, this coating can complicate the adherence of the filter wrapper paper.

Besides fluorinated hydrocarbons, it has also been suggested to use specially modified starch products, specifically starches substituted with octenyl succinate, for impregnation of papers for food packaging, see WO 2008/100688. However, these starches have the disadvantage that to achieve the desired effect, they have to be applied to the paper in a comparatively large amount. A sufficient effect could only be achieved with an application of an amount of more than about 80 kg of this starch product per ton of paper.

If the proposed method were applied to a filter wrapper paper, this ratio would correspond to an application of typically more than 2 g/m$^2$. This would increase not only the material costs, but also the energy demand for drying in an unfavorable manner.

Also in CA 2467601, the application of starch products to achieve oil resistance is described. There, it is suggested to use a composition consisting of a modified starch, an agent to increase the mechanical flexibility, for example glycol, and an agent for the adjustment of the rheological behavior. Although the mechanical flexibility of the coating can be improved, it is necessary according to that patent specification to apply more than 75 kg of this composition per ton of paper in order to ensure sufficient oil resistance. Hence also here the material consumption and the related costs for material and energy for drying of the paper are comparatively high. The effect could also only be demonstrated for papers with a basis weight of more than 37 g/m$^2$, which corresponds to an application of at least 2.78 g/m$^2$. It is in no way obvious that the effect described in the above patent specification can be readily transferred to filter wrapper papers with a significantly lower basis weight. Moreover the use of glycols in papers for cigarettes is not allowed in some countries.

In the case of filter wrapper papers, which are generally substantially lighter and thinner than food packaging papers, proportionally higher application amounts of these starch products are needed based on the paper mass, because the papers can only provide less resistance to the oil due to their low basis weight and low thickness, and because, due to the low basis weight, the application per weight unit of the filter wrapper paper occurs over a comparatively larger area.

Besides additional costs, the application of large amounts of starch products brings about also further disadvantages. For example, papers which are coated intensively with starch tend to dust, which increases the number of cleaning cycles on processing machines and reduces their productivity.

SUMMARY

The object of the invention is to provide a filter wrapper paper, which can be produced at low cost and still has sufficient resistance to oil and mechanical properties advantageous for further processing.

This objective is achieved by a filter wrapper paper according to claim 1, as well as a method for its production according to claim 11. Advantageous developments are disclosed in the dependent claims.

The filter wrapper paper according to the invention comprises a share of long-fiber pulps of at least 30% by weight, preferably at least 40% by weight, based on the pure fiber mass of the paper. Furthermore, the filter wrapper paper is characterized by the combination of the following three features:

(i) The refining degree of the long-fiber pulp is between 80° SR and 100° SR, preferably between 85° SR and 95° SR, according to ISO 5267, Schopper-Riegler method.

(ii) The filter wrapper paper has a filler content of <10% by weight, preferably <8% by weight and especially preferably <6% by weight, based on the total paper mass, and (iii) The filter wrapper paper is impregnated with a material that is suitable to form an aqueous composition, in particular an aqueous solution or suspension.

The inventors have found that, by combination of these features, a filter wrapper paper can be produced, which has a KIT level according to Tappi T559 cm-02 of at least 4, typically even of 5 or more. This is true even if the filter wrapper paper as initial material, i.e. still without impregnation, has a very low basis weight of 15-35 g/m$^2$.

This is, from the inventors' viewpoint, a surprising and unforeseeable result, which is quite obviously to be attributed to a synergy effect between the three features (i) to (iii). Even a combination of two of the above features (i) to (iii) does not provide such a positive effect, as is shown in greater detail with reference to comparative examples. The investigations of the inventors indicate, in fact, that this special technical effect is achieved only by combination of these three specific features.

As mentioned above, the filter wrapper paper according to the invention allows a sufficient oil resistance with comparatively low basis weights from 15 to 35 g/m$^2$, based on the initial material without impregnation. Preferred papers are considered to be those that have a basis weight before impregnation of 20-30 g/m$^2$, more preferably of 20-25 g/m$^2$. Such filter papers can have a mean air permeability according to ISO 2965 of less than 12,000 cm$^3$/(cm$^2$ min kPa), preferably less than 8,000 cm$^3$/(cm$^2$ min kPa). The effect according to the invention can also be achieved with filter papers with higher basis weight. However, with filter papers above 35 g/m$^2$, it is also possible to achieve sufficient oil resistance by other, conventional methods, other than in the range preferred here, for which the prior art does not really provide a satisfying solution according to the knowledge of the inventors.

Due to the impregnation and an additional optional application of material as described below, the basis weight of the finished filter wrapper paper is increased. Preferred ranges for the finished filter wrapper paper are between 15.5-24.0 g/m$^2$, preferably 20.5-39.0 g/m$^2$, and especially preferably 20.5-34.0 g/m$^2$.

The adequate amount of coating material for impregnation can be determined experimentally, such that the desired oil resistance is provided. Preferably, the contribution of the material for impregnation to the basis weight of the finished filter papers is 0.5-3.0 g/m$^2$, preferably 1.0-2.5 g/m$^2$, and especially preferably 1.3-2.0 g/m$^2$.

As mentioned above, the filter wrapper paper of the invention is impregnated with a material that is suitable to form an aqueous composition, particularly an aqueous solution or suspension. This aqueous solution or suspension can then be used during the impregnation in order to penetrate the material into the paper, whereas the aqueous part is evaporated or vaporized after impregnation. Favorable materials for impregnation have proven to be starch or a starch derivate, preferably a hydrolyzed starch, particularly maltodextrin.

However, the invention is not limited to these materials. Instead of these, one or more of the following substances can be used for impregnation: gelatin, shellac, collodion, Arabic gum, agar-agar, tragacanth, locust bean gum, guar gum, carboxymethyl starch, alginic acid and salts thereof, especially sodium, potassium and calcium alginates, or a cellulose derivate, especially methyl cellulose or carboxy methyl cellulose and the sodium, potassium, calcium or magnesium compounds thereof.

As described above, a special feature of the filter wrapper paper according to the invention is that the amount of filler is selected to be relatively low. Nevertheless, fillers can be present, although in a comparatively smaller amount, these materials preferably being mineral fillers, especially calcium carbonate, kaolin, talcum, titanium dioxide or a mixture of two or more of these fillers.

Although even by the impregnation of the paper as described above—in combination with the specially high refining degree of the long-fiber pulp and the comparatively low content of fillers—an increase of the oil resistance sufficiently high for most applications can be achieved, the oil resistance can, if necessary, be further increased if a further material layer is applied, particularly printed on or sprayed on. This further material layer can basically be applied to any of the two sides of the filter wrapper paper. Preferably, it is applied at least to the side that in use faces the filter plug. In contrast to the impregnation, where the material is introduced into the paper, the optional further application of material is limited basically to the surface of the already impregnated paper and is hence denoted as "coating" in the present specification.

Preferably, the contribution of the further material layer to the basis weight of the finished filter wrapper paper in the treated area is 1.0-6.0 g/m$^2$, preferably 2.0-4.0 g/m$^2$. The limitation "in the treated area" indicates here that not necessarily the entire surface of the filter wrapper paper has to be coated with the further material. This is especially the case in the applications described further below, where the further material coating is used primarily to provide a self-adhesive effect.

The material of the further material layer is preferably also adequate to form an aqueous composition, especially an aqueous solution or suspension. Oxidized starch has proven to be especially advantageous. Nevertheless, all materials mentioned above in conjunction with the impregnation can also be considered.

Preferably, the material of the impregnation and/or the material of the further material layer is suitable to adhere the filter wrapper paper to itself, a filter plug and/or a tipping paper after wetting without any further adhesive. As explained in greater detail below with reference to the exemplary embodiments, the impregnation and the optional further coating serve not only to increase the oil resistance, but provide the filter wrapper paper, as a special further advantage, with a self-adhesive effect. To this end, the material of the impregnation or of the further coating merely has to be wetted and hence partly dissolved, whereupon it can be adhered to another section of the filter wrapper paper, the filter plug or a tipping paper. This self-adhesive effect can also be provided merely by the impregnation itself, but, however, is increased by the further material coating. If the impregnation alone is already sufficient to achieve the oil resistance, the application of the further material, i.e. the coating, can be limited to such selected areas serving as adhesive areas when the filter wrapper paper is adhered to itself, the filter plug or the tipping paper.

In the case of the production method according to the invention of the filter wrapper paper, initially a base paper having the above features (i) and (ii) is produced. Then, this base paper is impregnated with a suitable material in an aqueous composition, especially an aqueous solution or suspension. This impregnation can be carried out for example in the size press of a paper machine. Alternatively, the impregnation can be carried out by two-sided application of the aqueous composition in a film press of a paper machine or by two-sided roll application.

After impregnation and drying, the filter wrapper paper can be optionally coated with a further material as mentioned before. Gravure printing is preferred as a coating method. Further suitable application methods are flexographic printing, spraying or the application by a film press or a roll. It is, however, characteristic in this case that the material is only applied to the surface and is not introduced into the paper structure, as for example with impregnation in the size press.

DETAILED DESCRIPTION

It has been found that, by special fiber treatment, by appropriate selection of the paper composition and by impregnation of the paper with an aqueous composition, a surprising synergy effect can be achieved, which allows all aforementioned requirements to be achieved together simultaneously. This shall be illustrated by the following examples.

Examples 1-8

Insufficient Oil Resistance of Conventional and Modified Filter Wrapper Papers and Achievement of Oil Resistance by the Invention Several filter wrapper papers with a basis weight of about 23 g/m$^2$ were produced, comprising about 60% long-fiber pulp and about 40% short-fiber pulp, with both percentages based on the pure fiber mass, and a variable filler content of 0-10%, based on the total paper mass. Precipitated calcium carbonated (PCC) was used as a filler.

Besides the filler content, also the refining degree of the long-fiber pulp was varied. In table 1, "normal" indicates a long-fiber pulp with a conventional refining degree from 50 to 70° SR, whereas, in the case of the variants with highly refined long-fiber pulp ("intensive"), the long-fiber pulp was refined in a tandem disc refiner to a refining degree of 93° SR. The paper impregnation, if any, was carried out in the size press of the paper machine with a 10-15% aqueous suspension of a short-chain hydrolyzed starch, (Maltodexrin Eliane MD2 from Avebe, available for example via Brenntag CEE GmbH), such that the paper structure after drying contains about 1-2 g of this starch per square meter of paper, which is hereinafter denoted as the "application amount", although, strictly speaking, this is not an "application" in the meaning of a coating, but instead an impregnation. Unless stated otherwise, all percentages are based on % by weight.

To produce the starch suspension, 150 kg of this starch product were stirred in about 800 liters of tap water at room temperature with a common stirring device and after 5-15 minutes stirring the suspension was supplemented with tap water up to 1000 kg.

The amount of starch added to the paper by impregnation was determined as the difference in basis weight determined according to ISO 536 before and after the impregnation.

All papers were tested for their oil resistance according to Tappi T559 cm-02, wherein 9 tests were performed on each paper. The range of values obtained and all other results of these experiments are summarized in Table 1:

TABLE 1

Oil resistance of conventional, modified and coated filter wrapper papers

| | Filter Wrapper Paper | | Impregnation | | Oil |
|---|---|---|---|---|---|
| No. | Long-fiber pulp refining | Filler content [%] | Starch suspension [%] | Application amount [g/m$^2$] | Resistance KIT level |
| 1 | Normal | 10 | None | 0 | <1 |
| 2 | Intensive | 10 | None | 0 | <1 |
| 3 | Normal | 0 | None | 0 | 1 |
| 4 | Intensive | 0 | None | 0 | 1-2 |
| 5 | Normal | 10 | 12 | 1.5 | <1 |
| 6 | Intensive | 10 | 12 | 1.5 | <1 |
| 7 | Normal | 0 | 12 | 1.5 | 1-2 |
| 8 | Intensive | 0 | 10 | 1.2 | 5-6 |

Example 1 describes a conventional filter wrapper paper and hence shows that conventional filter wrapper papers do not have sufficient oil resistance.

In example 2, the long-fiber pulp was refined intensively, which leads to a denser paper structure. Nevertheless, no improvement of the oil resistance could be achieved.

In example 3, no filler was used. This measure also leads to a denser paper structure, but likewise hardly improves the oil resistance.

Example 4 shows that the combination of highly refined long-fiber pulp and the omission of filler also does not achieve a sufficient improvement of the oil resistance.

Examples 5-7 show the same papers as in examples 1-3, however with an additional impregnation by the starch suspension. Although the applied amount of starch corresponds to the quantity described in WO 2008/100688 or CA 2467601 and thus at least a small improvement of the oil resistance might have been expected, this cannot be confirmed experimentally.

From examples 1-7 it can therefore be concluded that the low basis weight and the low thickness of filter wrapper papers present a specific difficulty in the quest for oil resistance, and this difficulty cannot be overcome by prior art methods in an obvious way.

Surprisingly, the inventors have found that by means of combination of all these measures, that is to say:

by use of highly refined long-fiber pulp by reduction of the content of filler by impregnation with a starch suspension, a synergy effect can be achieved, which is not solely the result of the simple superposition of the individual contributions of these measures. This is because the measurements for the paper of example 8 show a KIT level of 5-6, while it was not possible to achieve a KIT-level of greater than 2 for any of the examples 1-7, in which up to two of the described measures were likewise applied. However, a KIT level of 5-6 already represents a sufficient oil resistance.

It should be noted that, in example 8, a KIT level of 5-6 can be achieved already by impregnation with only 1.2 g starch per square meter of paper, while an impregnation with 1.5 g starch per square meter of paper in examples 5-7 caused no considerable improvement.

Examples 9-20

Applicability of the Invention in the Field of Typical Filter Wrapper Papers

The following examples show that the observed synergy effect is not strongly dependent on the paper properties, but can be used in the entire range of typical filter wrapper papers:

TABLE 2

Oil resistance of coated filter wrapper papers

| | Paper | | | Impregnation | Oil |
|---|---|---|---|---|---|
| No. | Basis weight [g/m$^2$] | Long fiber [%] | Filler quantity [%] | Application quantity [g/m$^2$] | Resistance KIT level |
| 9 | 20 | 55 | 2 | 1.2 | 4-5 |
| 10 | 25 | 55 | 2 | 1.3 | 5-6 |
| 11 | 30 | 55 | 2 | 1.4 | 8-9 |
| 12 | 25 | 30 | 2 | 1.2 | 4-5 |
| 13 | 25 | 45 | 2 | 1.3 | 6-7 |
| 14 | 25 | 70 | 2 | 1.4 | 6-8 |
| 15 | 25 | 55 | 4 | 1.3 | 6-7 |
| 16 | 25 | 55 | 6 | 1.3 | 6-7 |
| 17 | 25 | 55 | 8 | 1.2 | 4-6 |
| 18 | 25 | 55 | 2 | 1.5 | 5-7 |
| 19 | 25 | 55 | 2 | 1.7 | 6-8 |
| 20 | 25 | 55 | 2 | 2.0 | 8-9 |

From examples 9-11 it can be seen that an increasing basis weight is beneficial for the oil resistance and hence with increasing basis weight either a higher KIT level with the same amount applied during impregnation can be achieved, or the same KIT level can be maintained with a lower amount applied during impregnation. The method can be performed with similar results for filter wrapper papers, with basis weights from about 15 g/m$^2$ to about 35 g/m$^2$. Based on these examples, the basis weight will preferably be selected from the range of 20 g/m$^2$ to 30 g/m$^2$ and especially preferably from the range from 20 g/m$^2$ to 25 g/m$^2$. Here, the basis weight denotes the basis weight of the filter wrapper paper before impregnation, which is hereinafter also referred to as the "initial basis weight". The described effect can also be achieved for an initial basis weight of greater than 35 g/m$^2$, but for such papers other known methods can also be used to achieve oil resistance.

In examples 12-14, the content of highly refined long-fiber pulp with constant fiber weight is varied. As expected, an increasing oil resistance arises with increasing content of long-fiber pulp, since the highly refined long-fiber pulp contributes to a denser paper structure. To achieve a sufficient oil resistance, the content of long-fiber pulp, based on the total fiber mass of the paper, should be at least 30%, preferably at least 40%. In principle, there is no reason not to use up to 100% long-fiber pulp. However, for very high contents of long-fiber pulp, the advantages in the oil resistance do not increase in the same way as for low contents. Since long-fiber pulp is usually more expensive than short-fiber pulp and also the refining is associated with energy costs, there is an ideal content of long-fiber pulp for each application, inter alia also due to economic considerations.

Concerning the refining of the long-fiber pulp, an effect is produced from a refining degree of about 80° SR, however a range from 85° SR to 95° SR is preferred. Since the tensile strength of the paper decreases with increasingly severe refining, the long-fiber pulp is not to be refined arbitrarily intensively. An upper limit for the refining degree of the long-fiber pulp is fixed at 100° SR.

Finally, in examples 15-17, the filler content (here: precipitated calcium carbonate) in the filter wrapper paper is varied. An increasing content of calcium carbonate or similar fillers opens the paper structure and deteriorates the oil resistance, such that the content of calcium carbonate, as can be concluded from example 6, has to be chosen in any case to be less than 10%, preferably less than 8%, and especially preferably less than 6%. It is also possible to avoid the use of fillers entirely. Since, on the one hand, calcium carbonate is more cost-effective than pulp and, on the other hand, with a higher filler content more starch may have to be used in the impregnation, the specific choice of the filler content to achieve sufficient oil resistance—within the limits defined here—results not least from economic considerations.

Finally, as shown in examples 10 and 18-20, the quantity of starch, which is applied to the paper during the impregnation, can be varied. When increasing the applied amount, an increasing oil resistance can be seen, wherein, as with the content of long-fiber pulp, the improvement in the oil resistance with greater applied amounts does not increase in the same way as for lower amounts. Suitable applied amounts have been found to be from 0.5 g/m$^2$ to 3 g/m$^2$, preferably between 1.0 g/m$^2$ and 2.5 g/m$^2$, especially preferably between 1.3 and 2.0 g/m$^2$.

Besides the impregnation with a suspension of a short-chain, hydrolyzed starch, which is shown here in the examples, the invention can also be achieved by impregnation with other water-based compositions, such as solutions or suspensions. As alternative material to the short-chain hydrolyzed starch, gelatin, shellac, collodion, Arabic gum, agar-agar, tragacanth, locust bean gum, and guar gum are suggested for example, furthermore starch and starch derivates, such as carboxymethyl starch or alginic acid and salts thereof, especially sodium, potassium and calcium alginates as well as cellulose derivatives such as methyl cellulose or carboxymethyl cellulose and the sodium, potassium, calcium or magnesium compounds thereof Also mixtures containing one or more of these substances can be used. For the specific selection of the substance or substance mixture, the legal requirements should additionally be considered besides processability.

Since the possibility to increase the oil resistance by impregnation with increasingly higher amounts of starch is technically limited, it is suggested in a further embodiment of the invention to additionally apply a further aqueous composition to the surface of the paper after impregnation. The aqueous composition can contain a starch or a starch derivative, which can be the same as used for impregnation. In many cases however, a different substance or mixture of substances will be chosen, which is better applicable in the selected application method, for example due to the demands placed on rheological behavior.

A comparable effect can, for example, be achieved with gelatin, shellac, collodion, Arabic gum, agar-agar, tragacanth, locust bean gum, and guar gum, and furthermore with starch and starch derivatives such as carboxymethyl starch, or with alginic acid and salts thereof, especially sodium, potassium, and calcium alginates as well as with cellulose derivatives such as methyl cellulose or carboxymethyl cellulose and the sodium, potassium, calcium or magnesium compounds thereof.

Regarding the type of application method, there are no limitations. Conventional printing methods, such as gravure printing or flexographic printing can be used, but spraying of the composition is also possible, as is the one-sided application by a film press or a roll. It is characteristic however that the material is applied only to the surface and is not introduced into the paper structure, as is the case with the impregnation in a size press for example. For conceptual distinction of the above-mentioned "impregnation", this application of material provided in addition to the impregnation is denoted as "coating". This term is to be understood with a broad meaning and should merely express that the additional material is for the most part applied onto the already impregnated paper instead of being penetrated into the paper structure.

In the following examples, some of the already impregnated papers from examples 9-20 were additionally printed (i.e. "coated") over the entire surface with an approximately 20% aqueous composition, more specifically an aqueous suspension of an oxidized starch, (Perfectamyl A5760 from Avebe) in a conventional gravure printing method. Here, additionally 3 g of oxidized starch were applied per square meter of printed area of the paper:

TABLE 3

Oil resistance of printed and impregnated filter wrapper papers

| | Impregnated paper | KIT level | |
|---|---|---|---|
| Example no. | as in example no. | before printing | after printing |
| 21 | 9 | 4-5 | 6-8 |
| 22 | 10 | 5-6 | 8-9 |
| 23 | 12 | 4-5 | 6-8 |
| 24 | 17 | 4-6 | 7-9 |

From examples 21-24 it can be seen that, by printing, a further increase of the oil resistance by 2-3 levels can be achieved in general, wherein the measurement of the oil resistance was taken on the printed side. When applied to the cigarette it is then recommended, but not absolutely necessary, that the printed side faces the filter plug.

The amount of solid matter in the aqueous composition, applied by gravure printing in addition to the aforementioned impregnation, provides noticeable effects in the range of 1.0-6.0 g/m$^2$ of printed area, however the range of 2.0-4.0 g/m$^2$ of printed area is preferred. The stated applied amounts are based on the dried paper, that is to say once the water of the applied aqueous composition has evaporated or vaporized. Also for other application methods it is to be expected that with an applied amount of 1.0-6.0 g/m$^2$, preferably 2.0-4.0 g/m$^2$, an at least approximately comparable effect to the gravure printing method can be achieved, since the oil resistance obviously depends more on the applied amount than on the method of application.

Example 25

Adherence of the Filter Wrapper Papers

The impregnation alone as well as in combination with the additional application to the surface ("coating") make it possible to obtain a filter wrapper paper that can be adhered to itself or to the filter plug, without the use of further adhesives. Instead, it is sufficient to at first apply a small amount of water to a part of the surface or to the whole surface of the paper. There are no special requirements on the water, it can preferably be common tap water, although deionized water is also possible. The temperature of the water is likewise not of particular relevance for the adherence and is preferably in the range from 15° C. to 60° C.

Afterwards, the area wetted with water has to be brought into contact under slight mechanical pressure with the area to which it shall adhere and it has to be dried for a short time, preferably at elevated temperature, for example at about 60° C. Temperatures are preferred here that allow fast drying, preferably above 40° C., especially preferably above 50° C. However, the temperature should not be chosen to be so high that it leads to a thermal decomposition of the paper, for which reason it should be in any case below 105° C., preferably below 90° C.

Of particular importance during the production of cigarette filters is that the adherence reaches a certain minimum strength very quickly so that the filter does not burst open in the further processing steps or the filter wrapper paper separates from the filter. The adhesion is performed in such a way that the adhesive seam has a width of about 2 mm and is oriented in the machine direction of the filter wrapper paper. At the position where the filter wrapper paper is adhered to itself, the adhesion is between the upper side and the wire side of the filter wrapper paper.

To imitate this process in the laboratory, each of the papers from examples 10, 11, 14 and 22 was tested for its adhesive properties. Besides the paper from example 10 and its printed variant from example 22, which both represent an approximately average filter wrapper paper, the papers from examples 11 and 14 were also selected because they have a higher tensile strength due to the higher basis weight and the higher content of long-fiber pulp.

For the test, two strips of paper were first prepared, which had a width of 15 mm in machine direction and a length in the transverse direction sufficient for a tensile strength measurement according to ISO 1924-2. On the upper side of the first strip, water was applied with a brush along a straight line, about 2 mm wide oriented in machine direction, that is to say parallel to the short side of the strip. Thereafter, the paper strip was brought into contact with the wire side of the second strip so that, from the adherence of the two strips, a straight strip resulted with a width of 15 mm but now of a greater length. The seam was manually put under pressure for about 1 second using a flat metal body, which was heated to a temperature of about 60° C. Immediately afterwards, the adhered paper strip was provided for a tensile strength measurement according to ISO 1924-2. Here, the paper strip is fixed at both ends and stretched until it tears. In these experiments it was observed whether the tear occurred at the seam or at a different position on the paper strip. Four strips were tested per paper.

It was found that, apart from the paper of example 11, three or more of the four tested strips did not tear on the seam position. Hence the strength of the adhesion is already at this point in time higher than the tensile strength of the paper itself, for which reason it can be assumed that the strength of the adhesive bond is sufficiently high for machine processing. For example 11, this was not the case because the paper tore only once in four trials not at the seam position. However, because of the higher tensile strength of this paper, it can be assumed that in this case also the adhesive force is sufficiently high for the machine production of filters from this paper.

If a sufficient oil resistance of the paper can already be achieved by impregnation of the paper, but the adhesive force is not sufficient for machine processing, it is suggested that the composition intended for the application to the surface, or for the "coating", is not applied over the entire surface but only in partial areas. These partial areas can have any shape, but will be based upon the shape of the area to where they shall adhere. Preferably, these partial areas will be designed correspondingly with the areas of the filter wrapper paper provided with adhesive in the conventional production of filters.

The composition is typically and preferably applied in sub-areas to the side of the paper facing the filter plug. However, it is also conceivable for these sub-areas to be provided on the other side of the paper or on both sides of the paper, for example if an additional adhesion of the filer wrapper paper to the tipping paper is to be achieved in a later step of the cigarette production process.

The aforementioned features can be of significance in any arbitrary combination. And although various exemplary embodiments of the invention have been disclosed, it should be apparent to those skilled in the art that various changes and modifications can be made which will achieve some of the advantages of the invention without departing from the true scope of the invention.

What is claimed is:

1. A method for producing a filter wrapper paper, said method comprising the following steps:

refining a long-fiber pulp to a refining degree according to ISO 5267, Schopper-Riegler method, between 80° SR and 100° SR, producing a base paper which has a content of refined long-fiber pulp of at least 30% by weight based on the pure fiber mass, and which has a filler content of <10% by weight based on the total mass of the base paper, and impregnating the base paper with an aqueous composition.

2. The method according to claim 1, wherein the impregnation is carried out in one of a size press of a paper machine, in a film press of a paper machine, and by two-sided roll application.

3. The method according to claim 1, wherein, after the impregnation, a further material layer is applied on at least one section of the filter wrapper paper in the form of an aqueous composition.

4. The method according to claim 3, wherein the further material layer is applied in selected areas, which can serve as adhesive points, if the filter wrapper paper is adhered to itself, a filter plug or a tipping paper.

5. The method according to claim 3, wherein one or both of the aqueous composition for the impregnation and the aqueous composition for the further material application have a solid content of 5-20% by weight.

6. The method according to claim 1, wherein the base paper has a basis weight of 15-35 g/m$^2$.

7. The method according to claim 1, in which in said refining step, the long-fiber pulp is refined to a refining degree according to ISO 5267, Schopper-Riegler method between 85° SR and 95° SR.

8. The method according to claim 1, in which in the base paper producing step, a base paper having a content of refined long-fiber pulp of at least 40% by weight, based on the pure fiber mass, is produced.

9. The method according to claim 1, wherein in said base paper producing step, a base paper having a filler content of less than 8% by weight, based on the total mass of the base paper, is produced.

* * * * *